US011036166B2

(12) United States Patent
Miyazaki

(10) Patent No.: US 11,036,166 B2
(45) Date of Patent: Jun. 15, 2021

(54) FIXING DEVICE AND IMAGE FORMING APPARATUS

(71) Applicant: FUJI XEROX CO., LTD., Tokyo (JP)

(72) Inventor: Akio Miyazaki, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/750,226

(22) Filed: Jan. 23, 2020

(65) Prior Publication Data

US 2021/0080881 A1 Mar. 18, 2021

(30) Foreign Application Priority Data

Sep. 17, 2019 (JP) ..... JP2019-168447

(51) Int. Cl.
*G03G 15/20* (2006.01)

(52) U.S. Cl.
CPC ..... *G03G 15/2039* (2013.01); *G03G 15/2053* (2013.01)

(58) Field of Classification Search
None
See application file for complete search history.

(56) References Cited

U.S. PATENT DOCUMENTS

2007/0086804 A1* 4/2007 Seorl ..... G03G 15/2035 399/69
2018/0217007 A1* 8/2018 Nagatomo ..... G01K 1/12

FOREIGN PATENT DOCUMENTS

JP 4673638 B2 4/2011

* cited by examiner

*Primary Examiner* — Jas A Sanghera
(74) *Attorney, Agent, or Firm* — Sughrue Mion, PLLC

(57) ABSTRACT

A fixing device includes a heating member, a detector, a holding member, and a biasing member. The heating member is configured to transport a recording medium while nipping the recording medium with a pressure member, so as to fix a toner image onto the recording medium. The detector is configured to measure a temperature of the heating member. The holding member holds the detector. The biasing member biases the holding member so as to bring the detector into contact with a surface of the heating member.

15 Claims, 8 Drawing Sheets

FIXING DEVICE AND IMAGE FORMING APPARATUS

CROSS-REFERENCE TO RELATED APPLICATION(S)

This application is based on and claims priority under 35 USC 119 from Japanese Patent Application No. 2019-168447 filed on Sep. 17, 2019.

BACKGROUND

(i) Technical Field

The present disclosure relates to a fixing device and an image forming apparatus.

(ii) Related Art

A fixing device having a contact thermistor has been known (see, for example, Japanese Patent Number 4673638). The contact thermistor is in contact with a surface of a heating roller and measures a surface temperature of the heating roller. The contact thermistor includes a metal plate that elastically deforms to be in contact with the heating roller, and a holder that holds the metal plate. The metal plate is provided with an element that measures the temperature on an opposite side of the metal plate to a surface that is in contact with the heating roller.

SUMMARY

Aspects of non-limiting embodiments of the present disclosure relate to preventing a decrease in measurement performance of a detector as compared with a structure in which a detector that measures a temperature of a heating member provided in a fixing device is held by a leaf spring and the detector is brought into contact with a surface of a heating member by an elastic force of the leaf spring.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a fixing device including: a heating member configured to transport a recording medium while nipping the recording medium with a pressure member, so as to fix a toner image onto the recording medium; a detector configured to measure a temperature of the heating member; a holding member that holds the detector; and a biasing member that biases the holding member so as to bring the detector into contact with a surface of the heating member.

BRIEF DESCRIPTION OF THE DRAWINGS

Exemplary embodiment(s) of the present disclosure will be described in detail based on the following figures, wherein.

DETAILED DESCRIPTION

Hereinafter, exemplary embodiments of the present disclosure will be described in detail with reference to the accompanying drawings. Hereinafter, an upstream side in a transport direction of a recording sheet P may be simply referred to as an "upstream side" or "upstream", and a downstream side in the transport direction may be simply referred to as a "downstream side" or "downstream". The recording sheet P is an example of a recording medium. It is assumed that in each figure, an arrow UP indicates an upper direction of an image forming apparatus 10.

Overall Configuration

Figure 1:
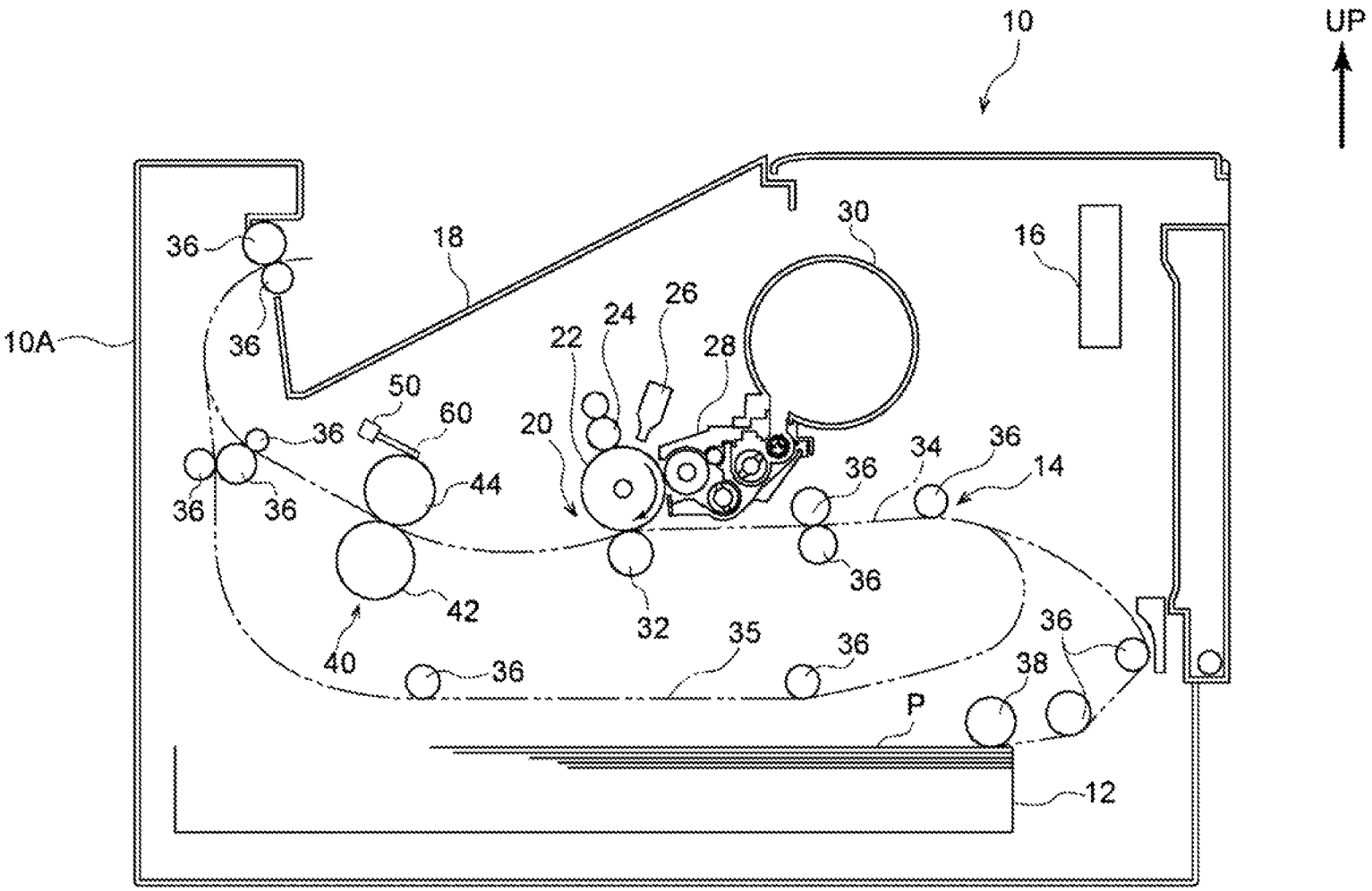
FIG. 1 is a schematic configuration view showing an image forming apparatus according to the present exemplary embodiments.

As shown in FIG. 1, the image forming apparatus 10 includes a device main body 10A that accommodates components therein. An accommodating unit 12 that accommodates the recording sheets P, a transport unit 14 that transports the recording sheet P accommodated in the accommodating unit 12, and an image forming unit 20 that forms a toner image on the transported recording sheet P are provided inside the device main body 10A.

Further, a fixing device 40 that fixes the toner image formed on the recording sheet P by the image forming unit 20 to the recording sheet P and a controller 16 that controls the operation of each unit of the image forming apparatus 10 are provided inside the device main body 10A. A discharge unit 18 that discharges the recording sheet P on which the image is fixed by the fixing device 40 is formed on an upper part of the device main body 10A.

Image Forming Unit

The image forming unit 20 is disposed substantially at a center in up and down directions in the device main body 10A. The image forming unit 20 includes an image carrier 22 that carries an image on a surface (an outer peripheral surface) thereof, a charging roller 24 that charges the surface of the image carrier 22, and an exposure device 26 that exposes the surface of the image carrier 22 charged by the charging roller 24 to form an electrostatic latent image on the surface of the image carrier 22.

The image forming unit 20 further includes a developing unit 28 that develops the electrostatic latent image formed on the surface of the image carrier 22 into a toner image with a developer, and a toner cartridge 30 that contains a developer to be supplied to the developing unit 28. The toner cartridge 30 is detachably attached to the device main body 10A. The image forming unit 20 includes a transfer roller 32 that transfers the toner image on the image carrier 22 to the transported recording sheet P.

Transport Unit

The transport unit 14 is disposed below the image forming unit 20 and includes plural transport rollers 36 that form the transport path 34 for the recording sheet P. The plural transport rollers 36 transport the recording sheet P delivered by a delivery roller 38, which will be described later, to the discharge unit 18 along the transport path 34. The transport unit 14 includes an inversion path 35 that reverses the recording sheet P and transports the reversed recording sheet P to the image forming unit 20 again in duplex printing. The reverse path 35 includes other transport rollers 36.

Accommodating Unit

The accommodating unit 12 is disposed below the transport unit 14, and accommodates the recording sheets P therein. The delivery roller 38 is provided in an upper part of the accommodating unit 12 and on a downstream side of the accommodating unit 12. The delivery roller 38 delivers the recording sheets P accommodated in the accommodating unit 12 one by one from the top. The recording sheets P are delivered to the transport path 34 by the delivery roller 38.

Fixing Device

The fixing device 40 is disposed downstream of the image forming unit 20. The fixing device 40 includes a heating roller and a pressure roller 42. The heating roller 44 is an example of a heating member. The heating roller 44 is disposed on an upper side of the transport path 34. The heating roller 44 is driven to rotate. The pressure roller 42 is an example of a pressure member. The pressure roller 42 is disposed on a lower side of the transport path 34. The pressure roller 42 is in contact with and pressed against a surface (outer peripheral surface) of the heating roller 44 with a predetermined pressure to form a nip portion. The pressure roller 42 rotates such that the pressure roller 42 follows the rotation of the heating roller.

Figure 4:
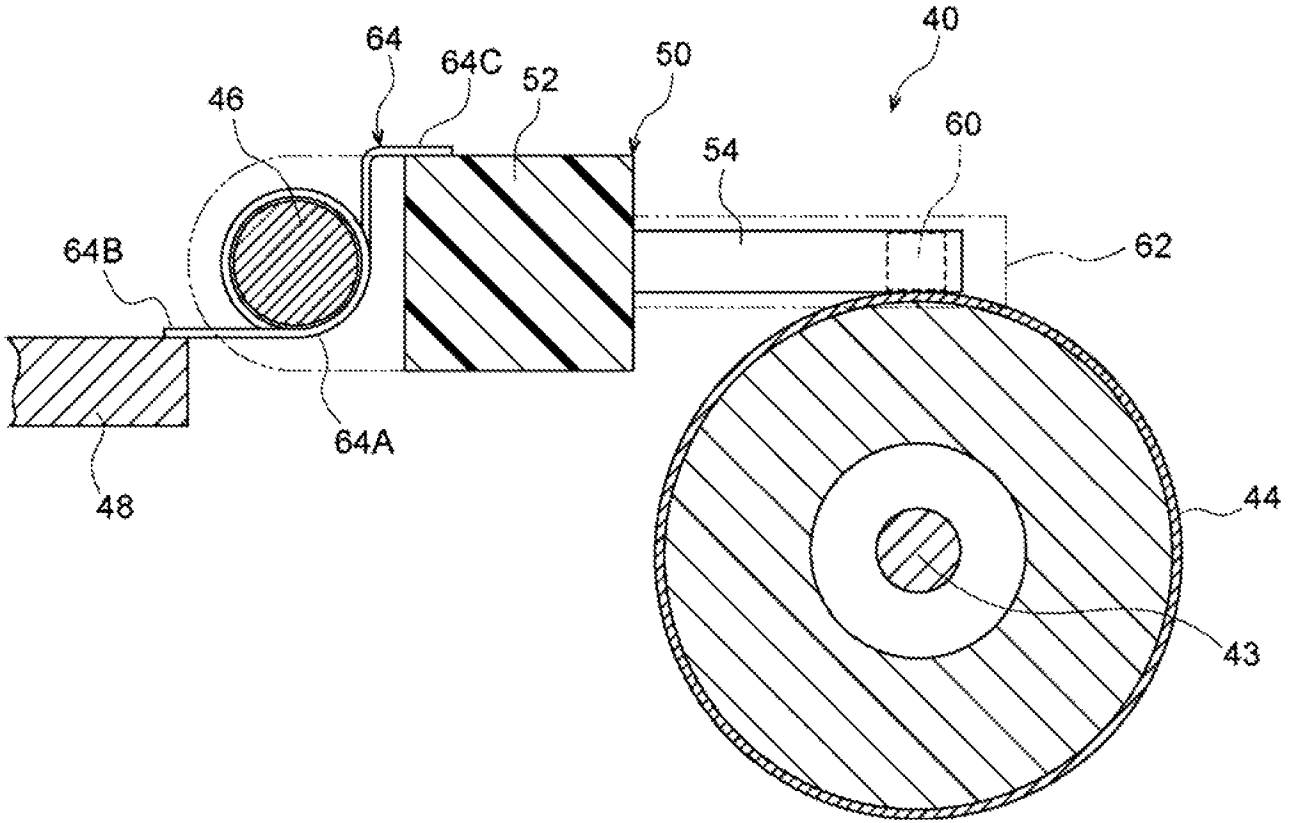
FIG. 4 is a side view showing the heating roller of the fixing device according to the first exemplary embodiment and the temperature sensor that measures the surface temperature of the heating roller.

A heater 43 is built in the heating roller 44 in an axial center part thereof (see FIG. 4). The heating roller 44 heats the recording sheet P on which the toner image is transferred in the image forming unit 20 while transporting and nipping the recording sheet P with the pressure roller 42, so that the toner image is fixed onto the recording sheet P. Other parts of the fixing device 40 will be described in detail later.

Effect of Overall Configuration

In the image forming apparatus 10 configured as described above, an image forming operation of forming an image on the recording sheet P will be briefly described by taking a case of single-sided printing as an example.

In the image forming unit 20, the surface of the image carrier 22 is charged by the charging roller 24. Then, the surface of the image carrier 22 is exposed by the exposure device 26, so that the electrostatic latent image is formed on the surface of the image carrier 22. The electrostatic latent image formed on the surface of the image carrier 22 is developed by the developing unit 28, so that a toner image is formed on the surface of the image carrier 22.

Meanwhile, the recording sheet P is delivered from the accommodating unit 12 by the delivery roller 38. The recording sheet P delivered by the delivery roller 38 is transported along the transport path 34 formed by the plural transport rollers 36, and is transported to a transfer position formed between the image carrier 22 and the transfer roller 32.

Then, at the transfer position, the toner image formed on the surface of the image carrier 22 is transferred to the recording sheet P. The recording sheet P to which the toner image is transferred is transported to the fixing device 40, and heated and pressed, so that the toner image is fixed to the recording sheet P. The recording sheet P on which the toner image is fixed is transported by the plural transport rollers 36 and is discharged to the discharge unit 18.

First Exemplary Embodiment

Next, the other parts of the fixing device 40 will be described in detail. First, the fixing device 40 according to the first exemplary embodiment will be described.

Figure 2:
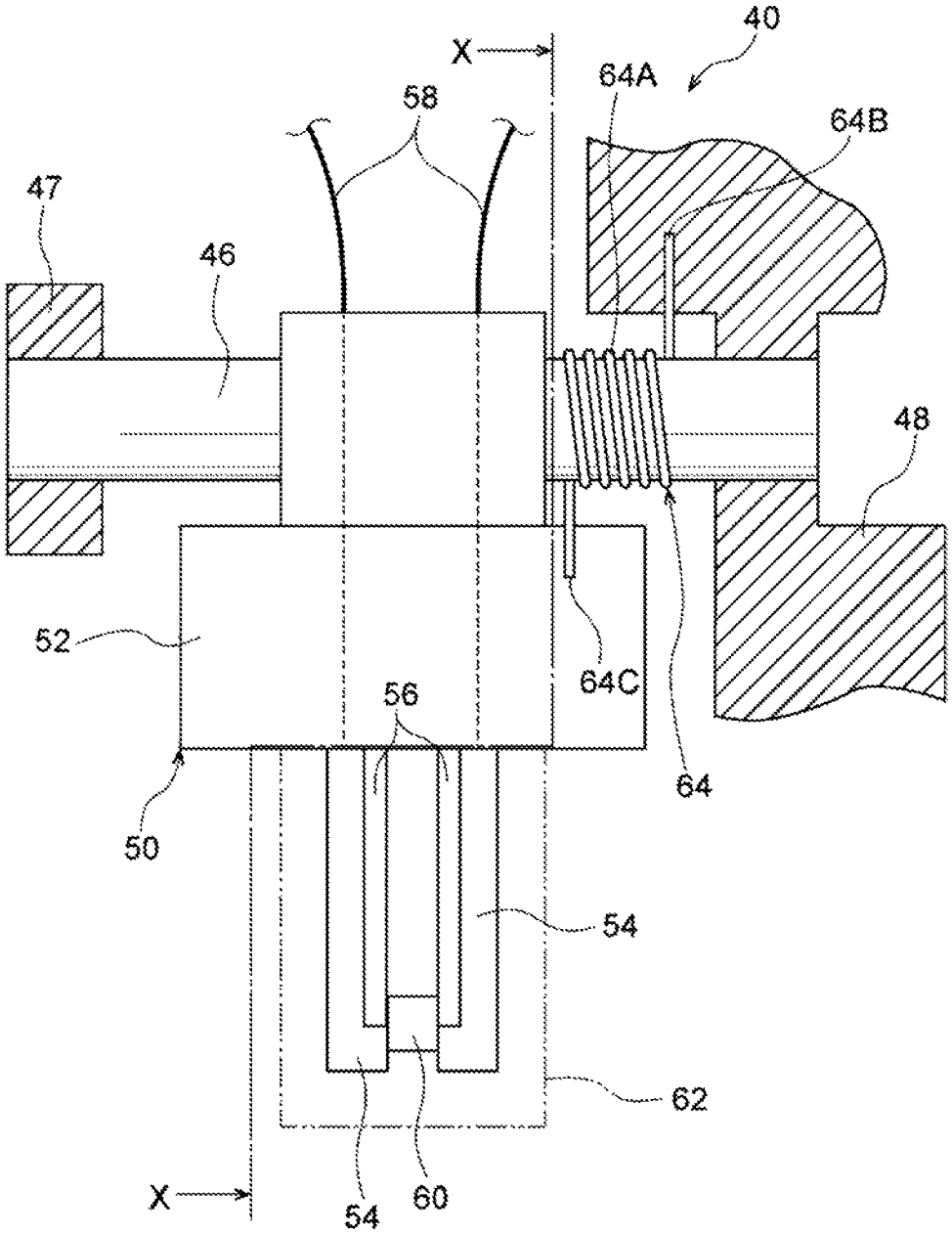
FIG. 2 is a plan sectional view showing the structure of a temperature sensor that measures a surface temperature of a heating roller of a fixing device according to a first exemplary embodiment.
Figure 3:
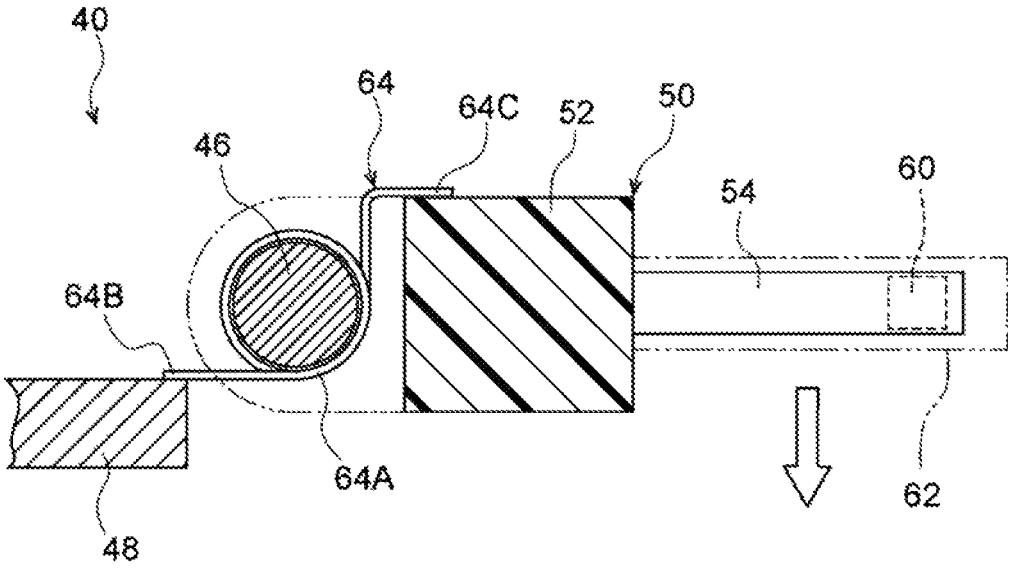
FIG. 3 is a sectional view of the structure taken along a line X-X of FIG. 2.

As shown in FIGS. 2 to 4, the fixing device 40 includes a temperature sensor 60, a holding member 50, and a torsion spring 64. The temperature sensor 60 may be a thermistor element. The temperature sensor 60 is an example of a detector. The temperature sensor 60 measures the surface temperature of the heating roller 44. The holding member 50 holds the temperature sensor 60. The torsion spring 64 is an example of a biasing member. The torsion spring 64 biases the holding member 50 so as to bring the temperature sensor 60 into contact with the surface of the heating roller 44.

A support shaft 46 having the same axial direction as the heating roller 44 is provided above the heating roller 44. Both axial end portions of the support shaft 46 are rotatably supported by bearing portions 47, 48, respectively. The holding member 50 includes a housing 52 and a pair of arms 54. The housing 52 is integrally provided on the outer peripheral surface of the support shaft 46. The housing 52 has a substantially "T" shape in a plan view. The arms 54 are integrally provided at a tip end portion of the housing 52.

That is, the housing 52 and the arms 54 are configured to rotate about the support shaft 46 together with the rotation of the support shaft 46. The housing 52 and the arms 54 are made of heat-resistant resin having excellent insulation properties. Examples of the heat-resistant resin include polyphenylene sulfide (PPS) and glass fiber reinforced polyethylene terephthalate (GF-PET).

A pair of electrode members 56 is provided inside a pair of the arms 54. Each electrode member 56 is made of metal such as stainless steel. A wiring harness 58 is attached to a base portion of each electrode member 56.

In order to control the heat generation of the heater 43 built in the heating roller 44, a temperature sensor 60 is provided at a tip end portion of the pair of electrode members 56. The temperature sensor 60 is brought into contact with the surface of the heating roller 44 to measure the surface temperature of the heating roller 44. In other words, the temperature sensor 60 for temperature control of the heating roller 44 is sandwiched between the tip end portions of the electrode members 56.

Figure 6:
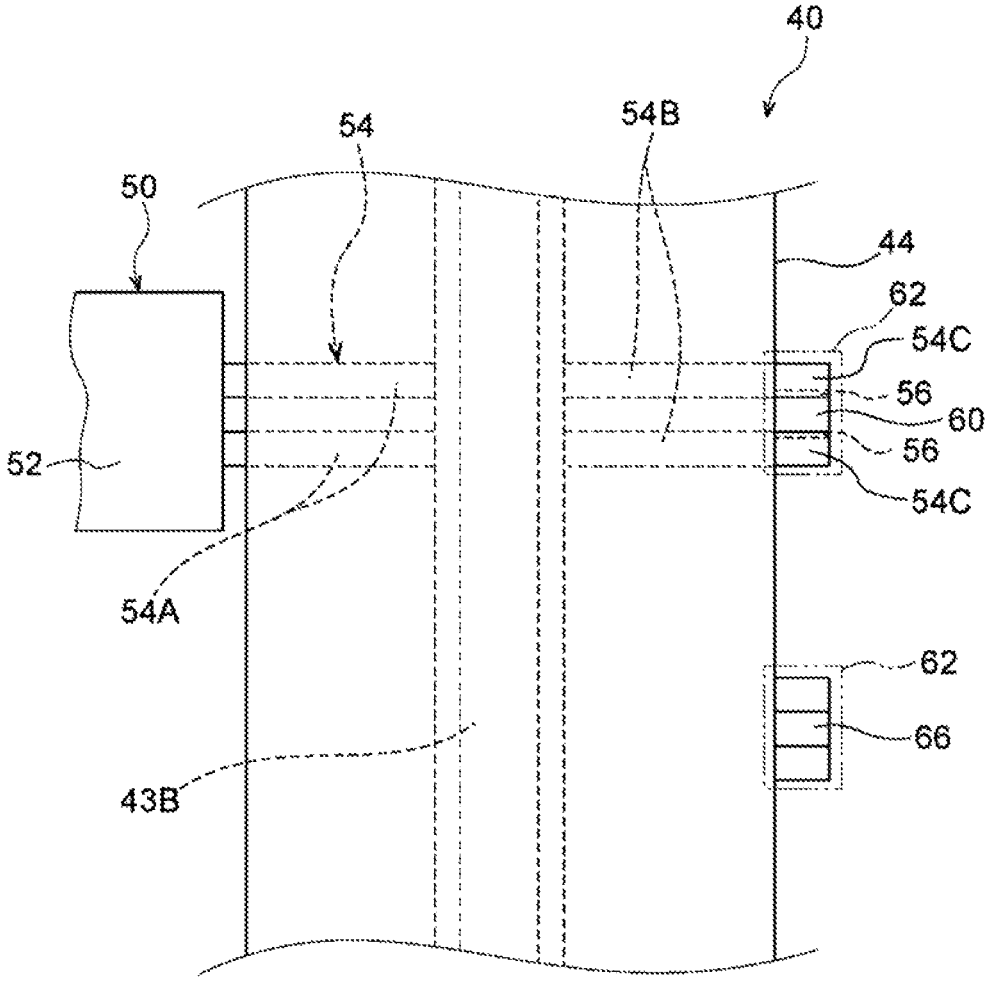
FIG. 6 is a bottom view showing the heating roller of the fixing device according to the second exemplary embodiment and the temperature sensor that measures the surface temperature of the heating roller.

The arms 54 and the electrode members 56 have the following configuration to facilitate sandwiching the temperature sensor 60 (see FIG. 6). That is, each of the arms 54 and the electrode members 56 is formed in a rectangular cross-sectional shape. A longitudinal direction of the rectangular shape is identical with a contact direction along which the temperature sensor 60 is brought into contact with the surface of the heating roller 44. A widthwise direction of the rectangular shape is identical with a sandwiching direction in which the electrode members 56 sandwich the temperature sensor 60.

Further, the pair of arms 54, the pair of electrode members 56, and the temperature sensor 60 are covered together by one protective sheet 62. That is, the pair of arms 54, the pair of electrode members 56, and the temperature sensor 60 are protected from dust and the like by the protective sheet 62.

A coil portion 64A of the torsion spring 64 is fitted to the support shaft 46. Then, one end portion 64B of the torsion spring 64 is hooked to one of the bearing portions 47, 48 (that is, the bearing portion 48). The other end portion 64C of the torsion spring 64 is hooked to the housing 52.

With this configuration, the temperature sensor 60 is biased via the housing 52 and the arms 54 so as to be brought into contact with the surface of the heating roller 44. The temperature sensor 60 is brought into contact with the surface of the heating roller 44 by the torsion spring 64 with a contact pressure that is a predetermined light pressure (for example, 0.01 kgf/cm$^2$≈980 Pa or less).

Next, an operation of the fixing device 40 according to the first exemplary embodiment configured as described above will be described.

Figure 8B:
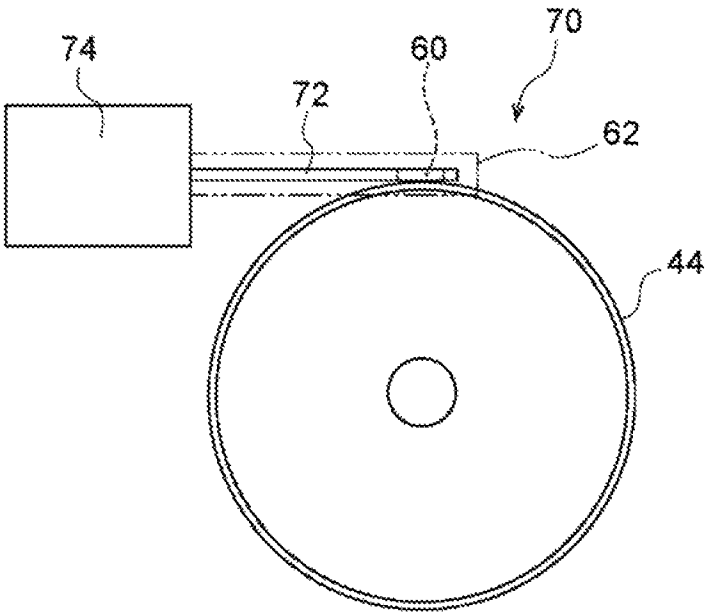
FIG. 8B is a side view showing the heating roller of the fixing device according to the comparative example and the temperature sensor that measures the surface temperature of the heating roller.
Figure 8A:
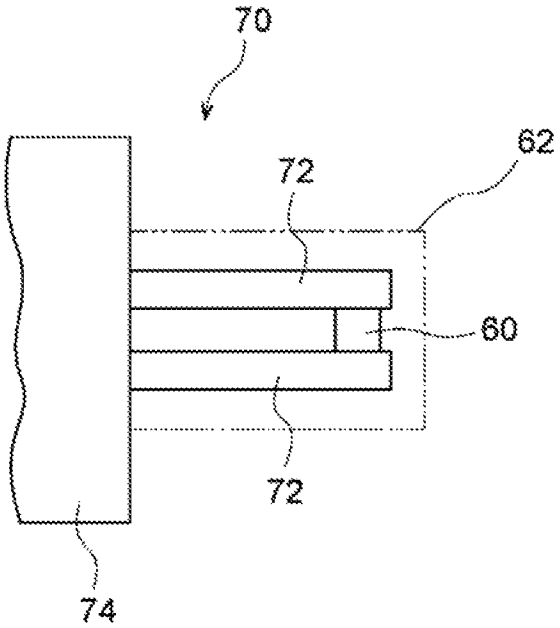
FIG. 8A is a plan view showing a temperature sensor that measures a surface temperature of a heating roller of a fixing device according to a comparative example.

First, a fixing device 70 according to a comparative example shown in FIGS. 8A and 8B will be described. As shown in FIGS. 8A and 8B, in the fixing device 70 according to the comparative example, a temperature sensor 60 that measures the temperature of a heating roller 44 is held at tip end portions of a pair of right and left leaf springs 72. The leaf springs 72 are, for example, thin leaf springs having a thickness of about 0.10 mm to about 0.15 mm.

The leaf springs 72 and the temperature sensor 60 are protected by a protective sheet 62. Base portions of the leaf springs 72 are fixed to a housing 74 provided at a predetermined position. The tip end portions of the leaf springs 72 are elastically deformed to be in contact with the surface of the heating roller 44. That is, the temperature sensor 60 is brought into contact with the surface of the heating roller 44 by elastic force (elastic restoring force) of the leaf spring 72.

During assemble of the fixing device 70 according to the comparative example, for example, the operator may touch the leaf spring 72 to thereby deform the leaf spring 72. When the leaf spring 72 is deformed, the elastic force of the leaf spring 72 would change, and the temperature sensor 60 may not be in contact the surface of the heating roller 44 properly. That is, measurement performance of the temperature sensor 60 that measures the surface temperature of the heating roller 44 may be reduced.

In contrast, in the fixing device 40 according to the first exemplary embodiment, as described above, the temperature sensor 60 is brought into contact with the surface of the heating roller 44 by a biasing force of the torsion spring 64 provided on the support shaft 46. Therefore, even if the operator touches the torsion spring 64 during assemble of the fixing device 40, the biasing force of the torsion spring 64 does not change.

That is, according to the fixing device 40 of the first exemplary embodiment, the temperature sensor 60 is appropriately in contact with the surface of the heating roller 44, and decrease in the measurement performance of the temperature sensor 60 that measures the surface temperature of the heating roller 44 is prevented as compared with the configuration according to the comparative example. Thus, deterioration of image quality caused by the decrease in the measurement performance of the temperature sensor 60 is prevented.

As described above, the biasing member for bringing the temperature sensor 60 into contact with the surface of the heating roller 44 includes the torsion spring 64. Thus, the fixing device 40 is easily assembled as compared with a case where the biasing member includes the leaf spring 72 or a coil spring (not shown). Since the coil portion 64A of the torsion spring 64 is fitted to the support shaft 46, the torsion spring 64 is unlikely to fall off from the support shaft 46.

The holding member 50 includes the pair of arms 54 that respectively support the electrode members 56 sandwiching the temperature sensor 60 at the tip end portions thereof. Therefore, insulating property between the electrode members 56 is good as compared with a case where the holding member 50 includes a single (common) arm (not shown) that supports the pair of electrode members 56.

Second Exemplary Embodiment

Next, a fixing device 40 according to a second exemplary embodiment will be described. The same components as those in the first exemplary embodiment are denoted by the same reference numerals, and detailed descriptions thereon (including the common operation) will be omitted as appropriate.

Figure 5:
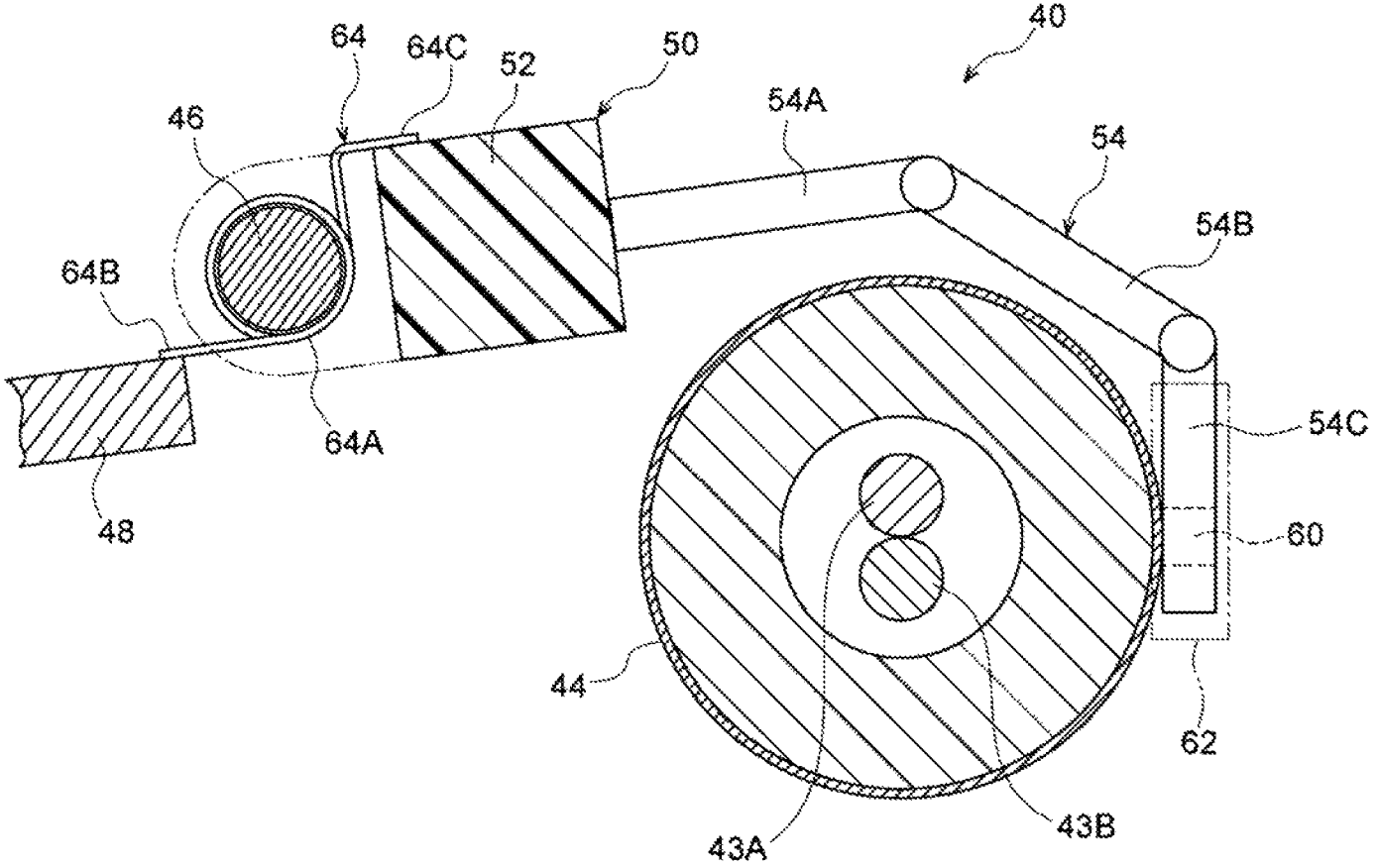
FIG. 5 is a side view showing a heating roller of a fixing device according to a second exemplary embodiment and a temperature sensor that measures a surface temperature of the heating roller.

As shown in FIGS. 5 and 6, the fixing device 40 according to the second exemplary embodiment differs from the first exemplary embodiment only in length and shape of the arms 54. That is, the arms 54 are longer than those of the first exemplary embodiment. The arms 54 are disposed along an outer shape (surface) of the heating roller 44.

Specifically, the pair of arms 54 includes a pair of first arms 54A, a pair of second arms 54B, and a pair of third arms 54C (see FIG. 5). When viewed from the axial direction of the support shaft 46, the first arms 54A project from the tip end portion of the housing 52, the second arms 54B are rotatably connected to tip end portions of the first arms 54A in a frictional manner, and the third arms 54C are rotatably connected to tip end portions of the pair of second arms 54B in a frictional manner.

Therefore, when viewed from the axial direction of the support shaft 46, each second arm 54B may be disposed at a rotation angle such that a substantial center part of the each second arm 54B in the longitudinal direction is close to the surface of the heating roller 44 (see FIG. 5). When viewed from the axial direction of the support shaft 46, each third arm 54C may be disposed at a rotation angle such that the tip end portion of each third arm 54C is close to the surface of the heating roller 44 (see FIG. 5). That is, each of the second and third arms 54B, 54C may be disposed at any position with respect to the surface of the heating roller 44 using the rotational resistance force due to the described friction, and may maintain a posture with which (a state in which) each of the second and third arms 54B, 54C is disposed at the position.

Further, a pair of electrode members 56 (see FIG. 2) is provided inside the pair of third arms 54C. The temperature sensor 60 is sandwiched between the tip end portions of the electrode members 56. Therefore, the protective sheet 62 in this case may be disposed so as to protect (cover) at least the pair of third arms 54C, the pair of electrode members 56, and the temperature sensor 60.

In the second exemplary embodiment, a temperature sensor 66 (see FIG. 6) different from the temperature sensor 60 is provided at the same position in a circumferential direction of the heating roller 44. That is, the temperature sensor 66 is provided as close as possible to an upstream side of the nip portion through which the recording sheet P passes. Two heaters 43A and 43B are built in a shaft center part of the heating roller 44 of the second exemplary embodiment. Heat generation of the respective heaters 43A, 43B are individually controlled using temperature measurement by the temperature sensors 60, 66 which are provided separately.

Next, an operation of the fixing device 40 according to the second exemplary embodiment configured as described above will be described.

As described above, in the second exemplary embodiment, the arms 54 are longer than those of the first exemplary embodiment. The arms 54 are disposed along the surface (outer shape) of the heating roller 44. Therefore, for example, even when (i) an installation position of the support shaft 46 is limited and (ii) the other temperature sensor 66 that measures the surface temperature of the heating roller 44 is provided at a position away from the support shaft 46, the temperature sensor 60 may be disposed in accordance with the position of the other temperature sensor 66.

Specifically, from a viewpoint of improving the accuracy of the temperature control of the heating roller 44, the temperature sensor 60 and the temperature sensor 66 may be disposed as close as possible to the upstream side of the nip portion through which the recording sheet P passes. Therefore, when the temperature sensor 66 (one of the temperature sensors 60, 66) is disposed at a position close to the upstream side of the nip portion through which the recording sheet P passes, the temperature sensor 60 (the other of the temperature sensors 60, 66) may be disposed at the same position as the temperature sensor 66.

Third Exemplary Embodiment

Finally, a fixing device 40 according to a third exemplary embodiment will be described. The same components as those in the first exemplary embodiment are denoted by the same reference numerals, and detailed descriptions thereon (including the common operation) will be omitted as appropriate.

Figure 7:
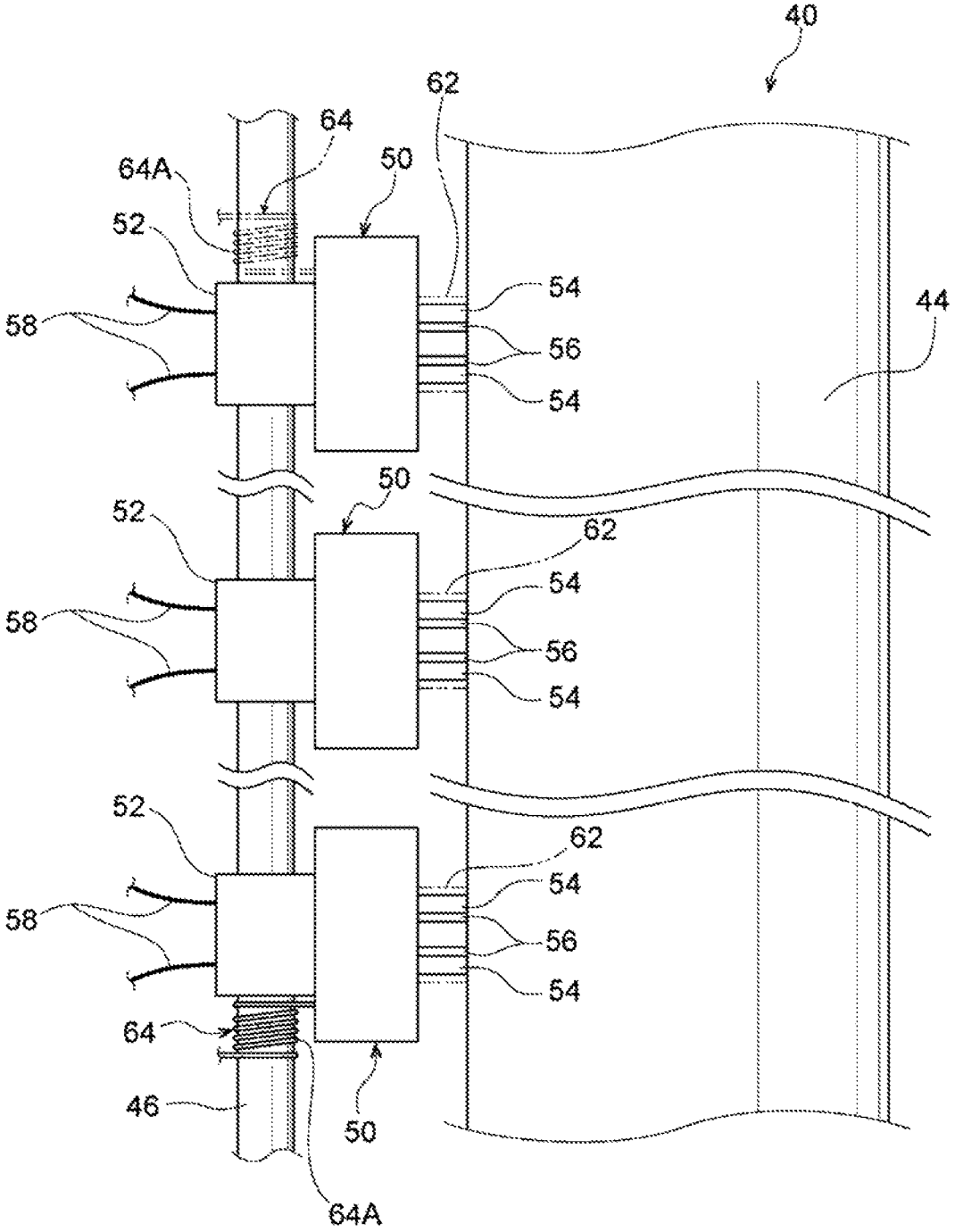
FIG. 7 is a bottom view showing a heating roller of a fixing device according to a third exemplary embodiment and a temperature sensor that measures a surface temperature of the heating roller.

As shown in FIG. 7, the fixing device 40 according to the third exemplary embodiment is different from the first exemplary embodiment only in that plural temperature sensors 60 and plural holding members 50 (each including the housing 52 and the pair of arms 54) are provided along the axial direction of the heating roller 44. That is, the plural holding members 50 are provided integrally with the outer peripheral surface of one support shaft 46 and face the same direction. The holding members 50 are rotatably supported by the support shaft 46 (the holding members 50 are configured to rotate together with the rotation of the support shaft 46).

Each holding member 50 is biased by one common torsion spring 64. Specifically, the coil portion 64A of the torsion spring 64 is fitted only to one end portion in the axial direction of the support shaft 46. One end portion 64B of the torsion spring 64 is hooked only to one of the bearing portions 47, 48 (that is, the bearing portion 48; see FIG. 2). The other end portion 64C of the torsion spring 64 is hooked only to one of the housings 52 on the one end portion side in the axial direction of the support shaft 46.

As shown by a phantom line in FIG. 7, the torsion springs 64 may be attached not only to one end portion in the axial direction of the support shaft 46 but also to the other end portion in the axial direction of the support shaft 46. That is, the plural holding members 50 may be biased by the two common torsion springs 64 provided at both end portions in the axial direction of the support shaft 46.

Next, an operation of the fixing device 40 according to a third exemplary embodiment configured as described above will be described.

As described above, in the third exemplary embodiment, the plural temperature sensors 60 and the plural holding members 50 (each including the housing 52 and the pair of arms 54) are provided along the axial direction of the heating roller 44. Therefore, the temperature of the heating roller 44 is measured more appropriately, and the accuracy of the temperature control of the heating roller 44 is improved as compared with a configuration in which a single temperature sensor 60 and a single holding member 50 are provided along the axial direction of the heating roller 44.

Further, in the third exemplary embodiment, the plural holding members 50 are biased by the one (or two) common torsion springs 64. Therefore, as compared with a case where the plural holding members 50 are biased by the torsion springs 64 provided separately, the number of components and manufacturing cost are reduced, and the fixing device 40 is assembled easily.

The fixing device 40 and the image forming apparatus 10 according to the exemplary embodiments have been described with reference to the accompanying drawings. It should be noted that the fixing device 40 and the image forming apparatus 10 according to the exemplary embodiments are not limited to those shown in the drawings, but may be appropriately changed or modified without departing from the scope of the present disclosure.

For example, a size of the protective sheet 62 is not limited to the illustrated size. The protective sheet 62 may have a size such that the protective sheet 62 covers at least the temperature sensor 60 and the tip end portions of the electrode members 56 sandwiching the temperature sensor 60. Further, the biasing member is not limited to the torsion spring 64. The biasing member may be implemented by, for example, a coil spring or the like (not shown).

Further, in the second exemplary embodiment, the pair of arms 54 is not limited to the arms each including the three sub-arms that are rotatably connected to each other. Although not shown, each of the arms 54 may include, for example, two sub-arms or four or more sub-arms that are rotatably connected to each other.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a heating member configured to transport a recording medium while nipping the recording medium with a pressure member, so as to fix a toner image onto the recording medium;

a plurality of detectors configured to measure a temperature of the heating member;

holding members that each hold one of the detectors;

a biasing member that biases the holding member so as to bring the detector into contact with a surface of the heating member; and the plurality of the detectors and the plurality of the holding members are provided along an axial direction of the heating member.

2. The fixing device according to claim 1, wherein the holding member is rotatably supported by a support shaft, and the biasing member includes a torsion spring provided on the support shaft.

3. The fixing device according to claim 2, wherein the holding member includes a pair of arms, and the arms respectively support electrode members provided on the detector.

4. The fixing device according to claim 1, wherein the holding member is disposed along an outer shape of the heating member.

5. The fixing device according to claim 2, wherein the holding member is disposed along an outer shape of the heating member.

6. The fixing device according to claim 3, wherein the holding member is disposed along an outer shape of the heating member.

7. The fixing device according to claim 2, wherein the heating member is formed in a roller shape.

8. The fixing device according to claim 3, wherein the heating member is formed in a roller shape.

9. The fixing device according to claim 7, wherein the plurality of holding members are rotatably supported by a single support shaft and are biased by a common biasing member.

10. The fixing device according to claim 8, wherein the plurality of holding members are rotatably supported by a single support shaft and are biased by a common biasing member.

11. An image forming apparatus comprising:

an image forming unit configured to form a toner image on a recording medium, and the fixing device according to claim 1, configured to fix the toner image, which is formed on the recording medium, onto the recording medium.

12. An image forming apparatus comprising:

an image forming unit configured to form a toner image on a recording medium, and the fixing device according to claim 2, configured to fix the toner image, which is formed on the recording medium, onto the recording medium.

13. An image forming apparatus comprising:

an image forming unit configured to form a toner image on a recording medium, and the fixing device according to claim 3, configured to fix the toner image, which is formed on the recording medium, onto the recording medium.

14. An image forming apparatus comprising:

an image forming unit configured to form a toner image on a recording medium, and the fixing device according to claim 4, configured to fix the toner image, which is formed on the recording medium, onto the recording medium.

15. A fixing device comprising:

heating means for transporting a recording medium while nipping the recording medium with pressure means, so as to fix a toner image onto the recording medium;

plural detecting means for measuring a temperature of the heating means;

holding means for holding each of the detecting means; and biasing means for biasing the holding means so as to bring the detecting means into contact with a surface of the heating means; and the plurality of detecting means and the holding means are provided along an axial direction of the heating means.

* * * * *